US005778609A

United States Patent [19]

Pawson et al.

[11] Patent Number: 5,778,609

[45] Date of Patent: Jul. 14, 1998

[54] FLOOR COVERINGS HAVING TREAD STRIPS ON A BACKING LAYER

[75] Inventors: Ian Karl Pawson, Whitbourne; Stephen James Pym, Shrewsbury, both of England

[73] Assignee: Nuway Manufacturing Company Limited, London, England

[21] Appl. No.: 740,056

[22] Filed: Oct. 24, 1996

[30] Foreign Application Priority Data

| | | | |
|---|---|---|---|
| Oct. 26, 1995 | [GB] | United Kingdom | 9521940 |
| Mar. 8, 1996 | [GB] | United Kingdom | 9604899 |
| Jul. 29, 1996 | [GB] | United Kingdom | 9615971 |

[51] Int. Cl.[6] ..... E04F 15/10

[52] U.S. Cl. ..... 52/181; 52/177; 15/238

[58] Field of Search ..... 52/177, 181; 15/238

[56] References Cited

U.S. PATENT DOCUMENTS

| | | | |
|---|---|---|---|
| 2,129,622 | 9/1938 | Manchester | 52/177 |
| 2,436,315 | 2/1948 | Liberatore | 15/238 |
| 2,531,659 | 11/1950 | Watson | 15/238 |
| 5,587,218 | 12/1996 | Betz | 52/181 X |

FOREIGN PATENT DOCUMENTS

| | | | |
|---|---|---|---|
| 451803 | 8/1936 | United Kingdom . | |
| 2080105 | 2/1992 | United Kingdom | 15/238 |
| 2 277 259 | 10/1994 | United Kingdom . | |

*Primary Examiner*—Christopher Kent

*Attorney, Agent, or Firm*—William A. Knoeller; Burns, Doane, Swecker & Mathis, L.L.P.

[57] ABSTRACT

A floor covering such as an entrance mat or tile comprises a plurality of tread strips retained in side-by-side relationship by being united with a backing layer. Some strips have fibrous tread surfaces. Other strips may have a zero or low pile content tread surface; these surfaces may be grooved.

19 Claims, 4 Drawing Sheets

FLOOR COVERINGS HAVING TREAD STRIPS ON A BACKING LAYER

BACKGROUND OF THE INVENTION

This invention relates to a floor covering suitable for use as an entrance mat or tile, and to a method of manufacture of a floor covering of a kind comprising a body of polymeric material which supports a tread surface of fibrous material.

A well established and successful modular construction of an entrance mat comprises a plurality of first strips of substantially rigid material, for example of aluminum or a plastics material such as polyvinyl chloride or polypropylene, and a plurality of second strips of substantially flexible and resilient material such as natural or synthetic rubber having an embedded reinforcement fabric. The second strips are interposed alternately between the first strips and the first and second strips are secured together in side-by-side relationship by means of one or more connecting wires which extend through aligned apertures in the first and second strips.

Conventionally each said second strip has an embedded reinforcement of one or more layers of fabric arranged to lie substantially transverse to the plane of the mat, and the surface of the rubber or like substantially resilient material is removed, typically by buffing, from a face of the strip which is to define the tread surface. This exposes the fibres and provides a fibrous tread surface.

A mat as described above will successfully remove loose or excess dirt from passing footwear, both when dry or when wet or heavily soiled. It is also easy to maintain, provides a pleasant visual appearance and is comfortable to walk over.

Manufacture of the mat is simple, but the need to position arrays of alternating strips of rigid and resilient material and the need to align apertures and insert and secure connecting wires inevitably militates against a low manufacturing cost. Reduction of the cost and time needed for buffing and removal of surface rubber would also be advantageous.

SUMMARY OF THE INVENTION

The present invention seeks to provide a floor covering and a method of manufacture of a floor covering suitable for use as an entrance mat or tile and which eliminates the need for at least some of the aforedescribed manufacturing operations.

The invention seeks also to provide a floor covering which can be of modular form, e.g. of a tile type section.

The present invention provides a floor covering comprising a plurality of tread strips each comprising a body of polymeric material having an embedded reinforcement of a plurality of layers of reinforcing material with each said layer arranged to lie substantially perpendicular to the plane of the floor covering and the layers of filamentary reinforcing material lying spaced apart transversely relative to the plane of the floor covering, at least some of said tread strips being fibrous tread strips which have a fibrous tread surface comprised by exposed ends of said embedded reinforcing material and the strips being arranged to extend parallel with one another with successive strips lying side-by-side in contact with one another and with the respective fibrous tread surfaces substantially aligned, the strips being retained in contact in said side-by-side relationship by means of a backing layer, said backing layer comprising a layer of polymeric material which resists substantial extension in a direction perpendicular to the longitudinal directions of the strips.

The invention further provides a method of manufacture of a floor covering comprising providing a plurality of tread strips each comprising a body of polymeric material having an embedded reinforcement of a plurality of layers of reinforcing material with each said layer arranged, in the finished product, to lie substantially perpendicular to the plane of the floor covering and with the layers of filamentary reinforcing material lying spaced apart transversely relative to the plane of the floor covering, at least some of said tread strips being fibrous tread strips which have a fibrous tread surface comprised by protruding exposed ends of said embedded reinforcing material, arranging the strips to extend parallel with one another with successive strips lying side-by-side in contact, providing a layer of a backing material adjacent a surface of the assembly of strips, holding the strips in side-by-side contact and uniting the backing layer with the strips while the strips are held in said side-by-side contact.

The polymeric material of the tread strips may be substantially resilient and may be a vulcanized material. The backing layer optionally may comprise a reinforcement structure to assist resistance to extension in a direction perpendicular to the longitudinal direction of the tread strips.

In addition to the fibrous type tread strips the floor covering may comprise spacer tread strips of a similar construction of spaced layers of reinforcing material embedded in polymeric material, but with the tread surface comprised primarily by the polymeric material and without the reinforcing material protruding or extending substantially beyond the adjacent polymeric material.

Preferably the embedded reinforcing material of the spacer type tread strips and optionally also the fibrous type tread strips comprises filaments which lie inclined to the surface of the floor covering. The filaments of one reinforcing layer preferably lie inclined in an opposite direction to the inclination of filaments in a neighboring layer. The filaments may be filaments of bias cut filamentary reinforcing material. The filaments preferably lie at an angle between 30° and 70° relative to the tread surface. The filaments in successive reinforcement layers preferably lie at equal but opposite angles of inclination.

The tread surface of a spacer type tread strips may have a grooved upper tread surface, typically having at least four grooves, each groove extending in the direction of the length of the tread strip.

Alternate layers of the reinforcement material may lie each at a respective peak between two grooves and optionally the reinforcement material may protrude slightly. The intervening layers of reinforcement material may lie each at a respective base of a groove and the reinforcement material may protrude slightly from the base or be flush with the embedding polymeric material.

The backing layer may be united with the strips by means of an adhesive or it may be substantially permanently united by bonding. The backing layer and strips may be of vulcanizable elastomeric material and bonding may be achieved by a hot or a cold cure vulcanization procedure, e.g. at a temperature in the order of 100° C. for cold cure and in the order of 160° C. for hot cure. Bonding may be achieved by a procedure of the kind known for the retreading of pneumatic tires. Strips of vulcanizable material may be vulcanized prior to said vulcanization procedure.

Each tread strip in a floor covering may be of substantially the same thickness, as considered in a direction perpendicular to the plane of the floor covering, thereby to provide a substantially smooth, planar tread surface. Alternatively the floor covering may comprise tread strips of two or more different thicknesses, e.g. to provide a ribbed tread surface if strips of two thicknesses alternate.

The floor covering structure may comprise a plurality of strips of the same type or some may provide a substantially plain surface and others a fibrous tread surface. Strips of two types may alternate with one another; strips with fibrous tread surfaces may have a thickness which results in the tread surfaces being slightly raised above the surfaces of adjacent strips which are bereft of a fibrous tread surface.

The tread strips may have a common tread surface color, or strips of two or more different colors may be combined.

The backing layer may contain a reinforcement that reinforces in only one direction or it may provide reinforcement in two mutually perpendicular directions. Preferably the reinforcement is substantially wholly embedded in the backing layer.

While it has been described that a fibrous tread surface may be formed by removing polymeric material to expose embedded reinforcement material, and create a high pile content surface, it is envisaged that the opposite surface of a tread strip, being the surface by which the strip is retained on the backing layer, will not have been subject to removal of a surface layer of polymeric material and will have a zero or low pile content surface.

The floor covering may be of a reversible type in which the backing layer is an interlayer each side of which is united with a respective one of a pair of pluralities of tread strips.

BRIEF DESCRIPTION OF THE DRAWINGS

An embodiment of the invention as applied to an entrance mat is now described with reference to the accompanying drawings in which.

DETAILED DESCRIPTION OF PREFERRED EMBODIMENTS

Figure 1:
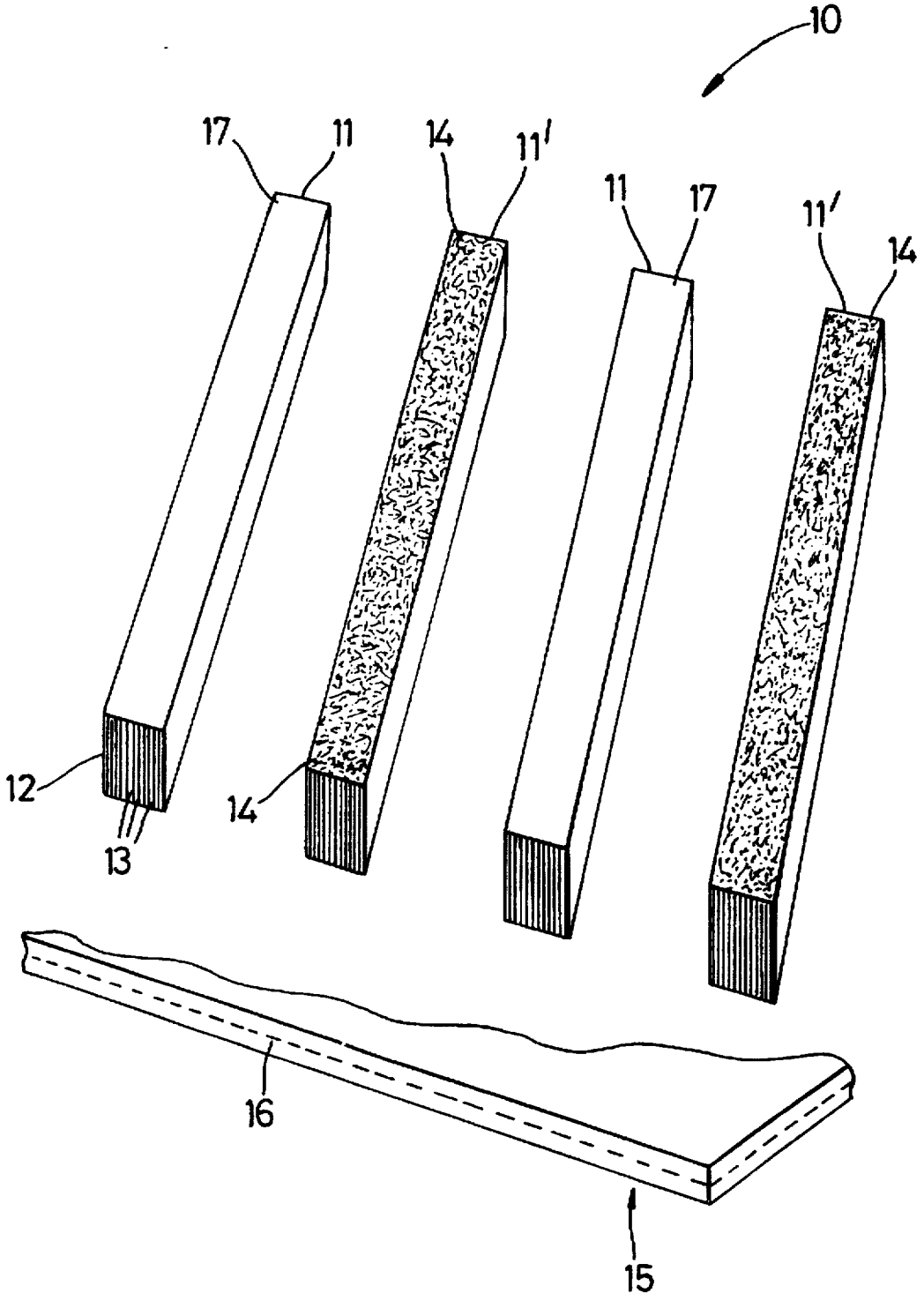
FIG. 1 is an exploded perspective view of part of an entrance mat.
Figure 2:
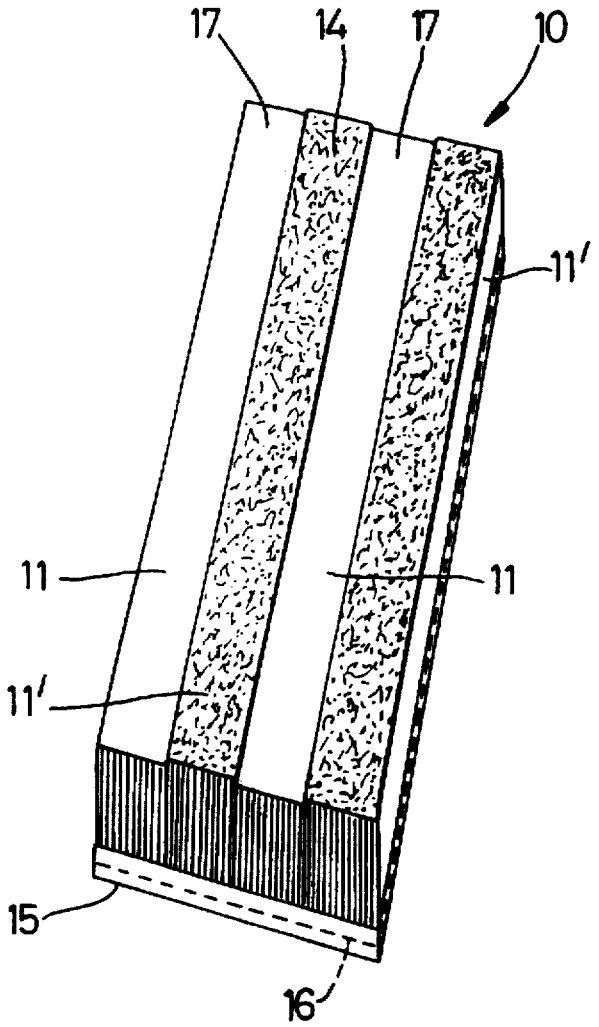
FIG. 2 is a non-exploded perspective view of the mat structure of FIG. 1.
Figure 3:
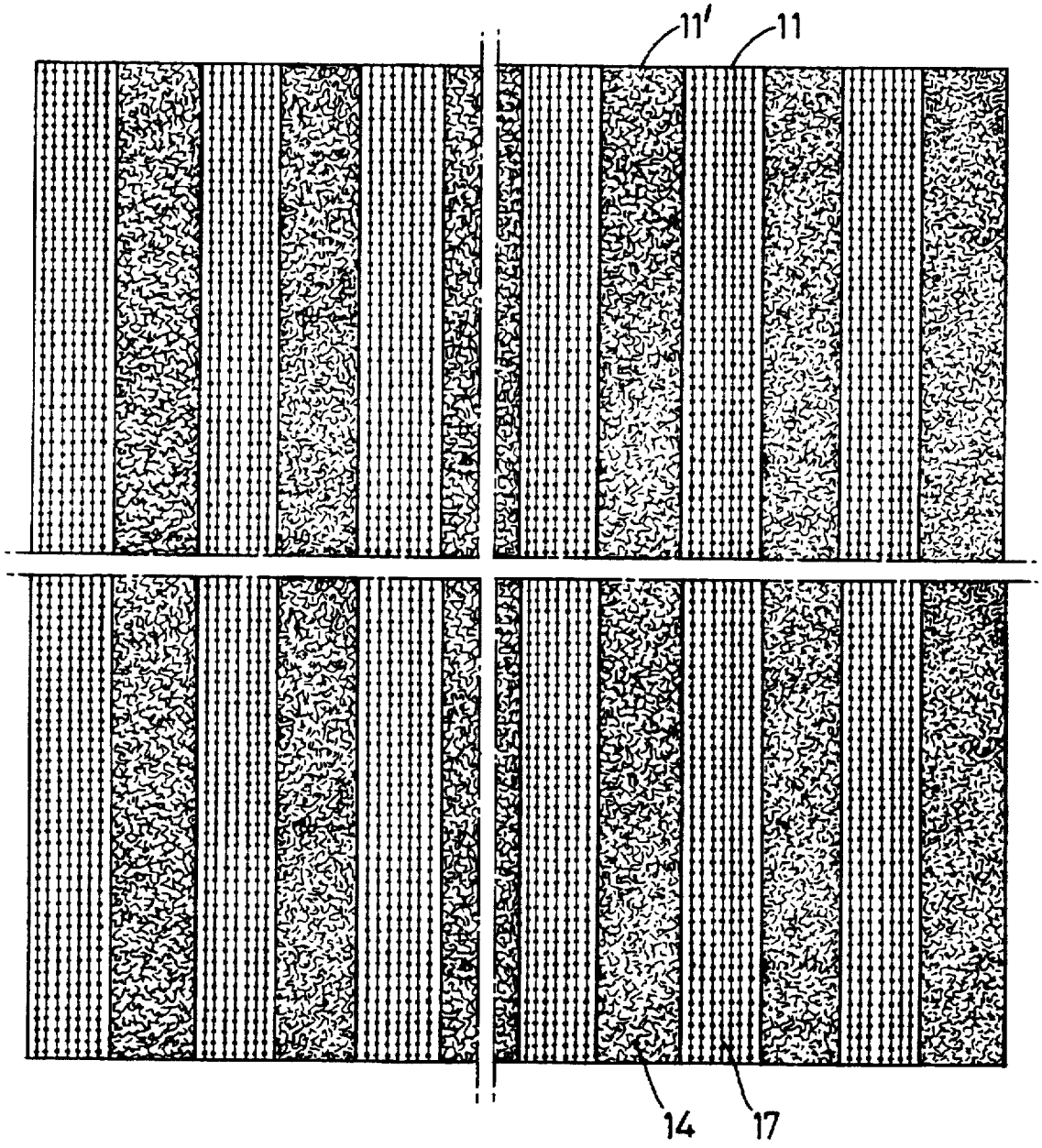
FIG. 3 is a plan view of part of the mat of FIG. 1.

The mat 10 comprises a plurality of elongate, rectilinear tread strips 11,11' each comprising a body 12 of natural or synthetic rubber with a plurality of layers 13 of bias cut nylon fiber fabric embedded therein. The rubber has been removed, by buffing from part of each alternate strip 11' where the edges of fiber layers 13 are exposed thereby to cause the fiber material to stand proud of the rubber and provide a foot-wiping tread surface 14. The strips 11' are fibrous type tread strips having a high pile content. The unbuffed strips 11 do not have any major pile content and are spacer type tread strips.

The strips 11,11' all lie side-by-side in close contact and are maintained in that relationship by means of a backing layer 15 to which they are each united.

The backing layer 15 comprises a sheet of natural or synthetic rubber and, optionally, has an embedded reinforcement of nylon fabric 16 which renders the layer 15 substantially inextensible.

The strips 11,11' are each united with the backing layer 15 by a cold bonding technique, the strips being held against one another by an external force until a bond is achieved.

The strips all have substantially the same thickness and the high pile content surfaces of the fibrous tread strips 11' co-operate to provide a substantially flat, smooth, fibrous tread surface. The fibrous tread surfaces 14 lie slightly raised above the surfaces 17 of the unbuffed strips 11.

Figure 4:
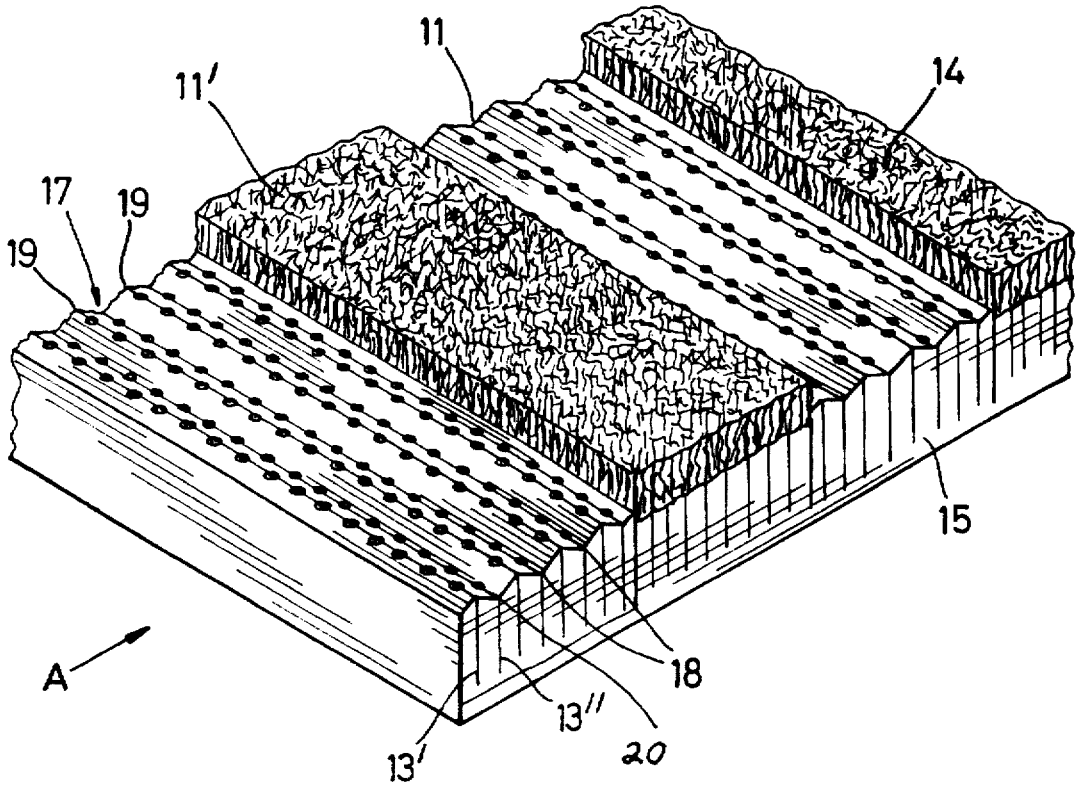
FIG. 4 is a perspective view of part of the assembled mat.

FIG. 4 shows a spacer strips 11 in more detail. The upper surface 17 comprises four grooves 18. The peak 19 between each pair of grooves is aligned with a layer 13' of embedded bias cut reinforcement. The base 20 of each groove is aligned with a layer 13" of embedded bias fabric. The fibers of the layers 13' protrude slightly and assist in providing a wiping action in use of the mat. The fibers of the layers 13" do not protrude but assist preservation of the grooved shape of the surface 17.

The layers 13',13" of bias cut reinforcement have warp reinforcing filaments, in the form of cords, which lie at 45° to the surface, and the warp filaments of layers 13' lie at right angles to those of the layers 13" when viewed in direction A of FIG. 4.

The resultant floor covering avoids the need for interconnecting wires and can readily be cut to size on-site. It avoids the need for all strips to be buffed but still achieves a good wiping action. It can be provided in the form of standard tile sections, as an entrance mat, or as a larger sized product.

What we claim is:

1. A floor covering comprising a backing layer of polymeric material defining a plane for said floor covering;

a plurality of tread strips on said backing layer, each said tread strip comprising a body of polymeric material having an embedded reinforcement of a plurality of layers of filamentary reinforcing material with each said layer arranged to lie substantially perpendicular to said plane;

the layers of filamentary reinforcing material lying spaced apart transversely relative to said plane;

at least some of said tread strips being fibrous tread strips which have a fibrous tread surface comprised by exposed ends of said embedded filamentary reinforcement material;

said tread strips being arranged to extend parallel with one another with successive tread strips lying side-by-side in contact with one another and with said respective fibrous tread surfaces substantially aligned;

said tread strips being retained in contact in said side-by-side relationship by said backing layer, the polymeric material of said backing layer resisting substantial extension in a direction perpendicular to a longitudinal direction of said strips.

2. Floor covering according to claim 1, in which at least some of said tread strips are spacer tread strips, each said spacer tread strip comprising spaced apart layers of reinforcing material embedded in polymeric material, each spacer tread strip having a tread surface comprised primarily by said polymeric material.

3. Floor covering according to claim 2, wherein the reinforcing material of a spacer tread strip does not protrude or extend substantially beyond said polymeric material.

4. Floor covering according to claim 1, wherein the embedded filamentary reinforcing material of said tread strips comprises filaments which lie inclined to an upper surface of the floor covering.

5. Floor covering according to claim 4, wherein the filaments of one reinforcing layer lie inclined in an opposite direction to the inclination of filaments in a neighboring layer.

6. Floor covering according to claim 4, wherein said filaments lie at an angle between 30° and 70° relative to said upper tread surface.

7. Floor covering according to claim 2, wherein the tread surface of a spacer tread strip has a grooved upper surface comprising grooves extending in a direction of the length of the tread strip.

8. Floor covering according to claim 7, wherein said grooved upper surface comprises at least four grooves.

9. Floor covering according to claim 7, wherein alternate layers of the reinforcing material in a tread strip lie each at a respective peak between two grooves.

10. Floor covering according to claim 7, wherein alternate layers of the reinforcing material in a tread strip lie each at a respective base of a groove.

11. Floor covering according to claim 1, wherein the backing layer is permanently united with the strips by bonding.

12. Floor covering according to claim 11, wherein the backing layer and strips comprise vulcanized elastomeric material.

13. Floor covering according to claim 1, wherein the tread strips are each of substantially the same thickness.

14. Floor covering according to claim 1, in which said fibrous tread strips are alternated with spacer tread strips.

15. Floor covering according to claim 14, in which upper surfaces of said fibrous tread strips lie raised slightly above upper surfaces of adjacent spacer tread strips which are bereft of a fibrous tread surface.

16. Floor covering according to claim 1, wherein the backing layer comprises a reinforcement that provides resistance to extension in a direction perpendicular to a longitudinal direction of the tread strips.

17. A method of manufacture of a floor covering having a backing layer defining a plane of said floor covering and a plurality of tread strips adhered to an upper surface of said backing layer, said method comprising providing a plurality of tread strips each comprising a body of polymeric material having an embedded reinforcement of a plurality of layers of filamentary reinforcing material;

arranging said tread strips on said backing layer so that said filamentary reinforcing material lies substantially perpendicular to said plane of the floor covering and with the layers of said filamentary reinforcing material lying spaced apart transversely relative to said plane, at least some of said tread strips being fibrous strips having an upper surface with protruding exposed ends of said embedded filamentary reinforcing material;

assembling the tread strips to extend parallel with one another with successive strips lying in side-by-side contact;

holding said tread strips in side-by-side contact while uniting said backing layer to a lower surface of said strips.

18. Method according to claim 17, wherein the strips and backing layer are formed from vulcanizable material and the strips are vulcanized prior to a vulcanization procedure to bond the strips to the backing layer.

19. Method according to claim 18, wherein the surfaces by which the strips are retained on the backing layer have a zero or low pile content.

* * * * *